US005491345A

United States Patent [19]

Stoutenburgh

[11] Patent Number: 5,491,345

[45] Date of Patent: Feb. 13, 1996

[54] SEALED VACUUM CANISTER AND METHOD FOR PICK-UP AND CONTAINMENT OF MATERIAL

[75] Inventor: Roger R. Stoutenburgh, Cutchogue, N.Y.

[73] Assignee: Associated Universities, Inc., Washington, D.C.

[21] Appl. No.: 317,171

[22] Filed: Oct. 3, 1994

[51] Int. Cl.[6] ..... G21F 5/00; B65D 81/20; B67C 3/16

[52] U.S. Cl. ..... 250/506.1; 206/524.8; 137/205

[58] Field of Search ..... 250/506.1; 376/272; 206/524.8; 137/205

[56] References Cited

U.S. PATENT DOCUMENTS

| | | | |
|---|---|---|---|
| 2,016,113 | 10/1936 | Lambert et al. | 221/73.5 |
| 3,873,271 | 3/1975 | Young | 206/524.8 |
| 3,983,872 | 10/1976 | Nehring | 128/278 |
| 4,185,355 | 1/1980 | Williams | 15/344 |
| 4,325,162 | 4/1982 | Chambers et al. | 15/327 |
| 4,328,423 | 5/1982 | Lorenzo et al. | 250/506 |
| 4,404,129 | 9/1983 | Penberthy | 250/506.1 |
| 4,425,114 | 1/1984 | Schoendorfer et al. | 604/7 |
| 4,625,122 | 11/1986 | Botzem et al. | 250/506 |
| 4,633,091 | 12/1986 | Kurasch et al. | 250/506 |
| 4,800,612 | 1/1989 | Valentine | 15/314 |
| 4,820,315 | 4/1989 | De Marco | 55/1 |
| 5,018,238 | 5/1991 | Nelle | 15/314 |
| 5,073,305 | 12/1991 | Miyao et al. | 252/633 |
| 5,084,937 | 2/1992 | Hague | 15/3.53 |
| 5,111,938 | 5/1992 | Soprano et al. | 206/524 |
| 5,273,561 | 12/1993 | Zerm | 55/216 |
| 5,310,388 | 4/1994 | Zerm | 15/327.1 |

*Primary Examiner*—Bruce C. Anderson
*Attorney, Agent, or Firm*—Margaret C. Bogosian

[57] ABSTRACT

A vacuum canister including a housing with a sealed vacuum chamber having a predetermined vacuum pressure therein and a valve having a first port for fluid communication with the vacuum chamber and a second port for receiving at least one of a fluid and a particulate material. The valve is operable between a first position to seal the vacuum chamber and retain the predetermined vacuum within the vacuum chamber, and a second position to access the vacuum chamber to permit vacuum fluid flow through the valve from the second port into the vacuum chamber. In operation of the vacuum canister to pick up material with the valve in the second position, when the second port is located adjacent at least one of a fluid and a particulate material, is effective to displace through the valve at least one of a fluid and a particulate material into the housing. The vacuum canister is desirably suitable for picking up and containing hazardous material such as radioactive material, in which the vacuum canister includes a protective layer of lead having a predetermined thickness that is effective to shield radiation emitted from the radioactive material contained within the housing. Advantageously, the vacuum canister includes a vacuum means for establishing a predetermined vacuum pressure within the vacuum chamber.

24 Claims, 2 Drawing Sheets

SEALED VACUUM CANISTER AND METHOD FOR PICK-UP AND CONTAINMENT OF MATERIAL

This invention was made with Government support under contract number DE-AC2-76CH00016, between the U.S. Department of Energy and Associated Universities, Inc. The Government has certain rights in the invention.

BACKGROUND

The present invention relates generally to a vacuum canister or container for picking up and containing a fluid or a particulate material. More particularly, this invention relates to a vacuum canister for picking up and containing a hazardous fluid or particulate material or waste.

Hazardous material includes chemical, radioactive, corrosive agent, poison, biomedical or any other material which can endanger human health or well-being if handled improperly. Various types of devices have been suggested to reduce the danger to human health from improper handling of hazardous material.

One type of device for picking up and containing material is a vacuum cleaner-type device that uses a fan to draw particles into an unsealed container. The unsealed container, however, allows smaller sized particles to escape out an exhaust port. Such devices are disclosed in U.S. Pat. Nos. 4,185,355; 4,325,162; 5,018,238; 5,084,937. Another type of device for containing material, particularly hazardous material, is a storage canister that can be sealed after the material has been placed within the canister. However, such a storage canister does not pick up the hazardous material for deposit into the canister. Such storage canisters are disclosed in U.S. Pat. Nos. 4,328,423; 4,625,122; 4,633,091; 5,111,938. Still another type of device for containing material is a storage container provided with vacuum means to draw a vacuum within the container after it is filled with a hazardous material. Such a storage canister for containment of radioactive material is disclosed in U.S. Pat. No. 5,073,305.

There is a need for a vacuum canister for quickly picking up material, particularly hazardous material, and safely containing the material to reduce the risk to human health or well-being from handling the material improperly.

SUMMARY

Accordingly, it is an object of the present invention to provide a vacuum canister that can be operated for controllably and repetitively picking up fluid and particulate material such as hazardous material for containment within the canister It is also an object of the present invention to provide a vacuum canister for picking up and containing hazardous material in which the vacuum canister is hand held and easily used, thereby reducing the amount of handling and risk of danger to human health from the hazardous material.

It is another object of the invention to provide such a vacuum canister that provides a storage container in which fluid and/or particulate hazardous material can be stored and easily identified by labeling the vacuum canister.

It is a further object of the invention is to provide such a vacuum canister for picking up and containing radioactive hazardous material and/or corrosive agent material in which the vacuum canister includes a protective layer of lead for shielding against radioactivity and/or a protective layer of glass for shielding against acids and bases.

Another object of the invention is to provide such a vacuum canister that is simple in construction and that may be manufactured relatively easily and inexpensively for widespread use for picking up, containing and disposing of hazardous material, thus lowering the costs associated with properly handling hazardous material from cleanup to disposal or remediation.

Certain of the foregoing and related objects are readily obtained in a vacuum canister for picking up and containing at least one of a fluid and a particulate material, in which the vacuum canister comprises generally a housing and a valve. The housing has a sealed vacuum chamber having a predetermined vacuum pressure therein. The valve has a first port operable to be placed in fluid communication with the vacuum chamber and a second port for receiving at least one of a fluid and a particulate material. The valve is operable between a first position to seal the vacuum chamber and retain the predetermined vacuum within the vacuum chamber, and a second position to allow fluid flow through the valve from the second port into the vacuum chamber, whereby operation of the valve, in the second position when the second port is located adjacent at least one of a fluid and a particulate material, is effective to displace through the valve the at least one of a fluid and a particulate material into the housing. The vacuum canister is desirably suitable for picking up and containing hazardous material such as corrosive agent material and radioactive material. For picking up and containing corrosive agent material, vacuum canister preferably includes a protective layer of glass having a predetermined thickness that is effective to contain the corrosive material within the vacuum canisters. For picking up and containing radioactive material, vacuum canister preferably includes a protective layer of lead having a predetermined thickness that is effective to shield radiation emitted from the radioactive material contained within the vacuum canister. The protective layer is disposed in substantially covering relationship to the vacuum chamber.

Preferably the vacuum canister includes a conduit in fluid communication with the second port of the valve. Advantageously, the housing is sized and configured to fit within a person's hand and the valve is sized and configured to be operable by a finger of a person's hand.

In an alternative embodiment of the invention for a vacuum canister for picking up and containing at least one of a fluid and a particulate material, the vacuum canister further includes vacuum means for establishing a predetermined vacuum pressure within the vacuum chamber. The vacuum means for creating a vacuum within the vacuum chamber includes a preselected substance disposed in communication with the vacuum chamber for causing a reaction with a gas within the vacuum chamber. An alternative embodiment of the vacuum means for establishing a predetermined vacuum pressure within the vacuum chamber includes a slidable housing member for expanding the volume of the vacuum chamber.

Certain of the foregoing and related objects are also readily obtained in a method for picking up and containing at least one of a fluid and a particulate material, the method includes the steps of: providing a housing having therein a sealed vacuum chamber; providing a valve having a first port in fluid communication with the vacuum chamber and a second port for receiving at least one of a fluid and a particulate material, the valve being operable between a first position to seal the vacuum chamber and retain a vacuum within the vacuum chamber, and a second position to permit fluid flow through the valve from the second port to the first port; establishing a predetermined vacuum pressure within the vacuum chamber; locating at least one of a fluid and a particulate material adjacent the second port; and placing the valve in the second position to displace along with fluid flow through the valve at least one of a fluid and a particulate material into the vacuum chamber.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

In the drawings, wherein similar reference characters denote similar elements throughout the several views.

DESCRIPTION

Figure 1:
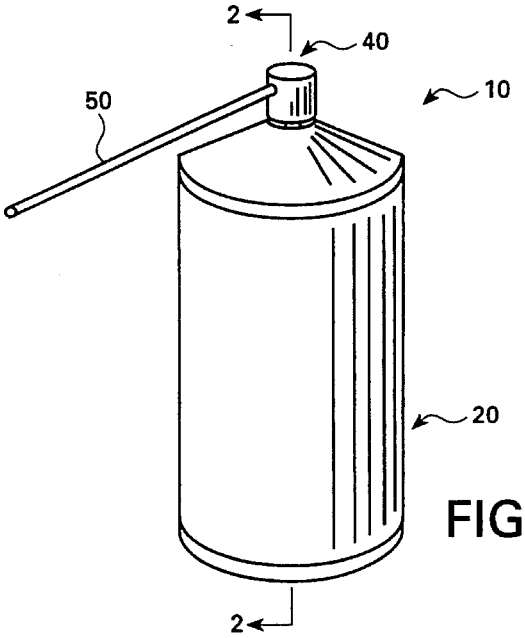
FIG. 1 is a perspective view of an apparatus embodying the present invention for a vacuum canister.
Figure 2:
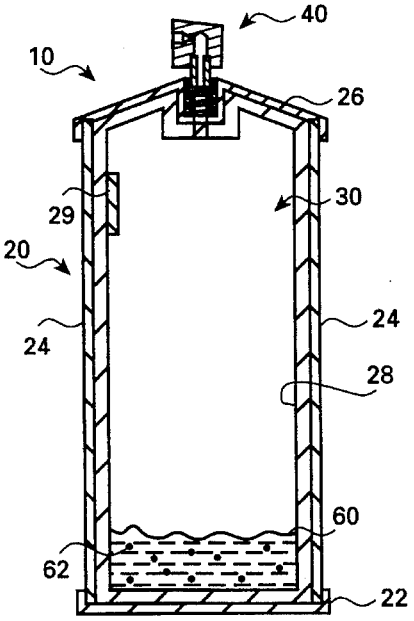
FIG. 2 is an alternative cross-sectional view taken along line 2—2 of the apparatus shown in FIG. 1.

Turning now to the drawings, and in particular to FIGS. 1 and 2, which illustrate a vacuum canister 10 embodying the present invention for picking up and containing a fluid or a particulate material, in which vacuum canister 10 includes a housing 20 having a predetermined vacuum pressure, a valve 40, and a conduit 50. Vacuum canister 10, by depressing valve 40, is effective to displace a fluid or a particulate material through conduit 50 for containment within housing 20. As shown in FIG. 2, a liquid 60 and a particulate material 62 are contained within vacuum canister 10.

Referring specifically to FIG. 2, housing 20 includes cylindrical side wall 24 attached at its lower end to a bottom 22 and attached to its upper end to a top 26 to define within housing 20 a vacuum chamber 30. Attached to top 26 is valve 40. Preferably, for containing hazardous material, housing 20 includes a protective layer 28 disposed in substantially covering relationship to vacuum chamber 30. Specifically, protective layer 28 is disposed in covering relationship on an inner surface of bottom 22, cylindrical side wall 24, and top 26. Particularly, for containing radioactive material, protective layer 28 is a predetermined thickness of lead that is effective to shield radiation from radioactive material contained within housing 20. Particularly, for containing a corrosive agent material, protective layer 28 is a predetermined thickness of glass that is effective to contain acids and bases within housing 20. When vacuum canister 10 is used to pick up and contain hazardous material, vacuum canister 10 can be labeled as shown in FIG. 1 with the words "HAZARDOUS MATERIAL" or as shown in FIG. 1 with a symbol for radioactivity.

Figure 3:
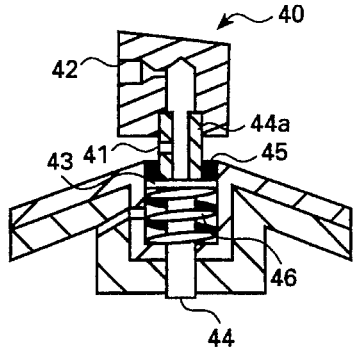
FIG. 3 is a partial, enlarged cross-sectional view of the valve shown in FIG. 2 in which the valve is shown in FIG. 3 in a closed position.
Figure 4:
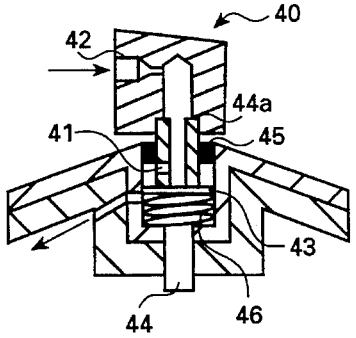
FIG. 4 is a partial, enlarged cross-sectional view of the valve shown in FIG. 2 in which the valve is shown in FIG. 4 in an open position.
Figure 6:
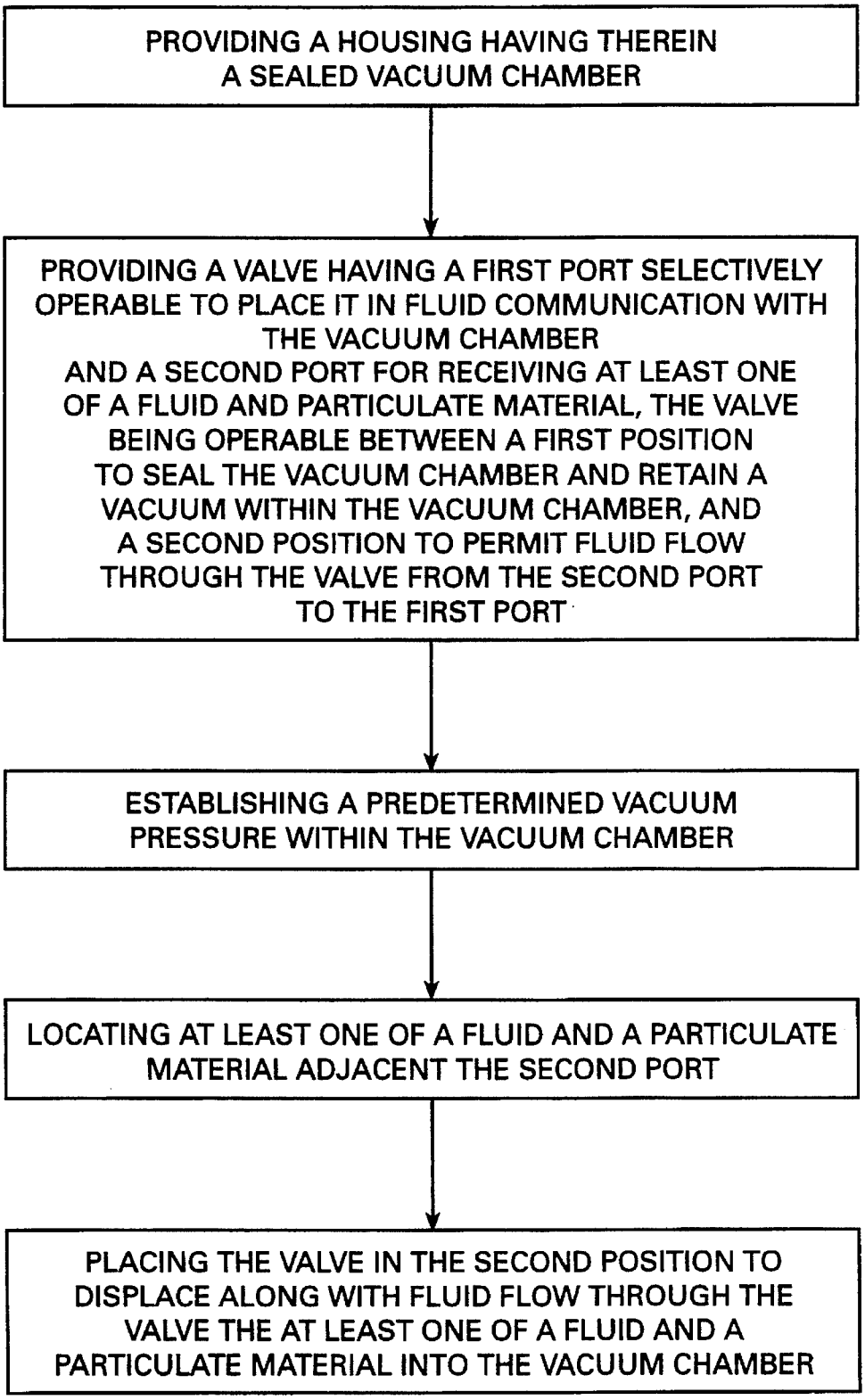
FIG. 6 is a flow chart illustrating the method of the present invention.

Referring now to FIGS. 3 and 4, valve 40 includes a first port 41 for fluid communication with vacuum chamber 30 and a second port 42 for receiving a fluid or a particulate material. Valve 40 is operable between a first or sealed position as shown in FIG. 3, and a second or open position as shown in FIG. 4. Specifically, valve 40 is operable between a first position to seal vacuum chamber 30 and retain a predetermined vacuum within vacuum chamber 30, and a second position to permit a vacuum fluid flow through valve 40 from second port 42.

Referring specifically to FIG. 3, valve 40 is shown in the first or sealed position, in which a shoulder 43 on stem 44 is forced tightly against a seat or gasket 45 by a biasing means such as a spring 46. Specifically, spring 46 applies force on shoulder 43 to counteract the force applied on shoulder 43 due to a vacuum within vacuum chamber 30. A predetermined vacuum pressure can be suitably formed within vacuum chamber 30 by depressing valve 40 to access vacuum chamber 30 while valve 40 is attached to a suitable vacuum pump. Valve 40 is then raised to seal the vacuum within vacuum chamber 30.

Referring now to FIG. 4, valve 40 is shown in the second position, in which shoulder 43 is pushed down away from seat 45. In operation of valve 40 in the second position, fluid flows into second port 42, thence through a hollow portion 44*a* of stem 44 and through first port 41; thus passing through top 26, protective layer 28 and into vacuum chamber 30. When a fluid or a particulate material is located adjacent port 42, the vacuum fluid flow through valve 40 is effective to displace a fluid or a particulate material through valve 40 and into vacuum chamber 30 in housing 20.

Preferably, biasing means for biasing valve 40 toward the first position to seal vacuum chamber 30 permits valve 40 to be selectively and repetitively moved to the second position to access vacuum chamber 30 and to permit fluid flow through valve 40. In this embodiment, instead of a single use in which the vacuum pressure is equalized with or toward atmospheric pressure, a single vacuum pressure is incrementally equalized with atmospheric pressure to incrementally displace fluid or particulate materials through valve 40 and into vacuum chamber 30 in housing 20. It will be appreciated that other suitable conventional valves could be equally well employed to seal vacuum chamber 30 in a first position and permit vacuum fluid flow through valve 40 in a second position.

Referring again to FIG. 1, conduit 50 is disposed to the exterior of valve 40 and conduit 50 has one end in fluid communication with second port 32 of valve 40. Conduit 50 enables a person to easily place the other or free end of conduit 50 adjacent a fluid or a particulate material to be displaced through valve 40 and into vacuum chamber 30 in housing 20 for containment. Upon depressing valve 40, a fluid vacuum flow is created to displace a fluid or a particulate material through valve 40 and into vacuum chamber 30. Advantageously, conduit 50 contains a small diameter passageway to limit the amount of vacuum fluid flow through conduit 50 when valve 40 is repetitively moved to the second position to access vacuum chamber 30 and to permit fluid flow through valve 40, thereby providing for multiple uses of vacuum canister 10 for picking up and containing a fluid or particulate material.

Preferably, vacuum canister 10 is sized and configured to fit within a person's hand along with being operable by depressing valve 40 with a finger. When not in use vacuum canister can be easily rested on a table. It is appreciated that housing 20 for retaining the predetermined vacuum can be configured to have a thicker side wall, concave bottom, etc. to better retain the predetermined vacuum.

In another embodiment of the invention for picking up and containing at least one of a fluid and a particulate material, vacuum canister 10, instead of having a predetermined vacuum pressure, further includes a vacuum means for establishing a predetermined vacuum pressure within vacuum chamber 30. As shown in FIG. 2, the vacuum means for creating a vacuum within the vacuum chamber includes a preselected substance 29 disposed in communication with vacuum chamber 30 for causing a reaction with a gas within vacuum chamber 30 to establish a predetermined vacuum. Preselected substance 29 may include sulfur, potassium nitrate or other ignitable substance, or a substance that naturally reacts with a gas such as air within vacuum chamber 30 to form a vacuum pressure. Suitable ignitable substances can be contacted with a high resistance wire having an applied electrical current to cause the high resistance wire to heat up and ignite the substance within vacuum chamber 30 and establish a predetermined vacuum. A vacuum pressure can be established in vacuum chamber 30 before using vacuum canister 10.

Figure 5:
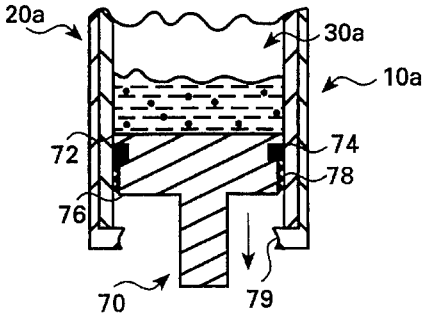
FIG. 5 is a partial, cross-sectional elevational view of an alternative embodiment of the present invention, showing a means for establishing a vacuum in the vacuum chamber.

Still another embodiment of the present invention is shown in FIG. 5. As shown in FIG. 5, vacuum canister 10*a* includes an alternative embodiment of a vacuum means for establishing a predetermined vacuum pressure within vacuum chamber 30*a*. Specifically, the vacuum means includes a slidable housing member 70 in which member 70 can be moved to increase the volume of vacuum chamber 30*a*. Member 70 includes an upper section 72 having a gasket or seal 74 that forms a seal against the inner surface of housing 20*a*, and a lower section 76 having external threads 78 that mates with an internally threaded bore 79 in the bottom of housing 20*a*.

Downward movement of member 70, in the direction of the arrow as shown in FIG. 5, increases the volume of vacuum chamber 30*a*. In operation, member 70 can be moved to establish a vacuum in vacuum chamber 30 before operating valve 40 (not shown in FIG. 5) or member 70 can be moved to establish a vacuum in vacuum chamber 30 while operating valve 40 (not shown).

The method according to the present invention for picking up and containing a fluid or a particulate material comprises the steps of: providing a housing having therein a sealed vacuum chamber, providing a valve having a first port in fluid communication with the vacuum chamber and a second port for receiving at least one of a fluid and a particulate material, the valve being operable between a first position to seal the vacuum chamber and retain a vacuum within the vacuum chamber, and a second position to permit fluid flow through the valve from the second port to the first port, establishing a predetermined vacuum pressure within the vacuum chamber, locating at least one of a fluid and a particulate material adjacent the second port, and placing the valve in the second position to displace along with fluid flow through the valve at least one of a fluid and a particulate material into the vacuum chamber. The vacuum canister is desirably suitable for picking up and containing hazardous material and most desirably suitable for picking up and containing radioactive material. Preferably, the step of providing a housing includes the step of providing a protective layer having a predetermined thickness that is effective to contain the hazardous material within said housing, said protective layer being disposed in substantially covering relationship to said vacuum chamber. Also preferably, the step of providing a valve includes the step of providing biasing means for biasing the valve toward the first position to seal the vacuum chamber. In this embodiment the valve is operable to be selectively or repetitively moved to the second position to repetitively permit fluid flow through the valve.

Thus, while only several embodiments of the present invention have been shown and described, it is obvious that many changes and modification may be made thereunto without departing from the spirit and scope of the invention.

I claim:

1. A vacuum canister for picking up and containing at least one of a fluid and a particulate material, comprising:

a housing with a sealed vacuum chamber having a predetermined vacuum pressure therein; and a valve having a first port operable to be placed in fluid communication with said vacuum chamber and a second port for receiving at least one of a fluid and a particulate material, said valve being operable between a first position to seal said vacuum chamber and retain said predetermined vacuum within said vacuum chamber, and a second position to permit fluid flow through said valve from said second port into said vacuum chamber;

whereby operation of said valve, in said second position when said second port is located adjacent at least one of a fluid and a particulate material, is effective to displace through said valve the at least one of a fluid and a particulate material into said housing.

2. The vacuum canister according to claim 1, wherein the at least one of a fluid and a particulate material is a hazardous material.

3. The vacuum canister according to claim 2, wherein said housing includes a protective layer having a predetermined thickness that is effective to contain the hazardous material within said housing, said protective layer being disposed in substantially covering relationship to said vacuum chamber.

4. The vacuum canister according to claim 3, wherein said hazardous material is a corrosive agent material.

5. The vacuum canister according to claim 4, wherein said protective layer is formed of glass.

6. The vacuum canister according to claim 3, wherein said hazardous material is a radioactive material.

7. The vacuum canister according to claim 6, wherein said protective layer is a predetermined thickness that is effective to shield radiation from the radioactive material contained within said housing.

8. The vacuum canister according to claim 7, wherein said protective layer is formed of lead.

9. The vacuum canister according to claim 1, further including a conduit disposed to the exterior of said valve and in fluid communication with said second port of said valve.

10. The vacuum canister according to claim 1, wherein said housing is sized and configured to be held by a person's hand.

11. The vacuum canister according to claim 10, wherein said valve is sized and configured to be operable by a finger of a person's hand.

12. The vacuum canister according to claim 1, wherein said valve includes biasing means for biasing said valve toward said first position to seal said vacuum chamber, said valve being operable to be selectively and repetitively moved to said second position to permit fluid flow through said valve.

13. A vacuum canister for picking up and containing at least one of a fluid and a particulate material, comprising:

a housing for forming therein a sealed vacuum chamber;

vacuum means for establishing a predetermined vacuum pressure within said vacuum chamber; and a valve having a first port for fluid communication with said vacuum chamber and a second port for receiving at least one of a fluid and a particulate material, said valve being operable between a first position to seal said vacuum chamber and retain a vacuum pressure within said vacuum chamber, and a second position to permit fluid flow through said valve from said second port to said first port;

whereby operation of said valve, in said second position when said second port is located adjacent at least one of a fluid and a particulate material, is effective to displace through said valve the at least one of a fluid and a particulate material into said housing.

14. The vacuum canister according to claim 13, wherein the at least one of a fluid and a particulate material is a hazardous material.

15. The vacuum canister according to claim 14, wherein said housing includes a protective layer having a predetermined thickness that is effective to contain the hazardous material within said housing, said protective layer being disposed in substantially covering relationship to said vacuum chamber.

16. The vacuum canister according to claim 13, wherein said valve includes biasing means for biasing said valve toward said first position to seal said vacuum chamber, said valve operable to be selectively or repetitively moved to said second position to permit fluid flow through said valve.

17. The vacuum canister according to claim 13, wherein said vacuum means for creating a vacuum within said vacuum chamber includes a preselected substance disposed in communication with said vacuum chamber for causing a vacuum-forming reaction with a gas within said vacuum chamber.

18. The vacuum canister according to claim 13, wherein said vacuum means for creating a vacuum within said vacuum chamber includes a slidable housing member for expanding the volume of said vacuum chamber.

19. The vacuum canister according to claim 13, wherein said housing is sized and configured to be held by a person's hand.

20. The vacuum canister according to claim 19, wherein said valve is sized and configured to be operable by a finger of a person's hand.

21. A method for picking up and containing at least one of a fluid and a particulate material, comprising the steps of:

providing a housing having therein a sealed vacuum chamber;

providing a valve having a first port selectively operable to place it in fluid communication with said vacuum chamber and a second port for receiving at least one of a fluid and a particulate material, said valve being operable between a first position to seal said vacuum chamber and retain a vacuum within said vacuum chamber, and a second position to permit fluid flow through said valve from said second port to said first port;

establishing a predetermined vacuum pressure within said vacuum chamber;

locating at least one of a fluid and a particulate material adjacent said second port; and placing said valve in said second position to displace along with fluid flow through said valve the at least one of a fluid and a particulate material into said vacuum chamber.

22. The method according to claim 21, wherein said at least one of a fluid and a particulate material is a hazardous material.

23. The method according to claim 22, wherein said step of providing a housing includes the step of providing a protective layer having a predetermined thickness that is effective to contain the hazardous material within said housing, said protective layer being disposed in substantially covering relationship to said vacuum chamber.

24. The vacuum canister according to claim 21, wherein said step of providing a valve includes the step of providing biasing means for biasing said valve toward said first position to seal said vacuum chamber, said valve being operable to be selectively or repetitively moved to said second position to permit fluid flow through said valve.

* * * * *